US006066082A

United States Patent [19]

Suketomo

[11] Patent Number: 6,066,082

[45] Date of Patent: May 23, 2000

[54] PAPER SHEET FOLDING APPARATUS

[75] Inventor: Seiji Suketomo, Hyogo, Japan

[73] Assignee: Fujitsu Limited, Kawasaki, Japan

[21] Appl. No.: 08/886,014

[22] Filed: Jun. 30, 1997

Related U.S. Application Data

[63] Continuation of application No. 08/435,368, May 5, 1995, abandoned.

[30] Foreign Application Priority Data

Jul. 11, 1994 [JP] Japan ..... 6-158434

[51] Int. Cl.[7] ..... B31B 1/26

[52] U.S. Cl. ..... 493/411; 493/414; 493/439

[58] Field of Search ..... 493/410–420, 493/436, 438, 439, 440

[56] References Cited

U.S. PATENT DOCUMENTS

| | | | |
|---|---|---|---|
| 2,906,527 | 9/1959 | Blain | 493/411 |
| 3,640,521 | 2/1972 | Hutley | 270/61 F |
| 4,193,313 | 3/1980 | Frandsen | 74/231 |
| 4,401,428 | 8/1983 | Thomas | 493/411 |
| 4,403,904 | 9/1983 | Chelin | 414/634 |
| 4,592,739 | 6/1986 | Ogawa | 493/415 |
| 4,622,028 | 11/1986 | Bunch, Jr. | 493/411 |
| 4,920,021 | 4/1990 | Kimura | 430/56 |
| 5,014,971 | 5/1991 | Folsom | 493/411 |
| 5,080,644 | 1/1992 | Bunch, Jr. | 493/411 |
| 5,082,756 | 1/1992 | Doi | 430/67 |
| 5,088,404 | 2/1992 | MacConnell et al. | 101/232 |
| 5,452,061 | 9/1995 | Kojima | 355/219 |
| 5,732,315 | 3/1998 | Inoue et al. | 399/317 |

FOREIGN PATENT DOCUMENTS

| | | |
|---|---|---|
| 63-252876 | 10/1988 | Japan . |
| 1-256467 | 10/1989 | Japan . |
| 57-98462 | 6/1992 | Japan . |
| 037832 | 2/1993 | Japan . |
| 5-193825 | 8/1993 | Japan . |

*Primary Examiner*—Stephen F. Gerrity
*Attorney, Agent, or Firm*—Armstrong, Westerman, Hattori, McLeland & Naughton

[57] ABSTRACT

A swing guide is provided under a fixed paper guide for guiding a paper sheet so as to swing through a specified angle. A movable paper guide is disposed at a paper transfer station where the paper sheet is transferred from the fixed paper guide to the swing guide. The movable swing guide swings, following the swinging movement of the swing guide and has a resistance reducing material on its inner face.

5 Claims, 6 Drawing Sheets

PAPER SHEET FOLDING APPARATUS

This application is a continuation of application Ser. No. 08/435,368 filed May 5, 1995, now abandoned.

BACKGROUND OF THE INVENTION (1) Field of the Invention

The present invention relates to a paper sheet folding apparatus and, more particularly, to a paper sheet folding apparatus for folding a continuous paper sheet having folding lines at predetermined intervals in such a manner that one side and the other side of the paper sheet alternately face up.

(2) Description of the Prior Art

In an image forming apparatus such as a printer or copying machine, after images have been formed on a continuous paper sheet in an image forming station, the continuous paper sheet is sequentially folded on folding lines by means of a paper sheet folding apparatus that is provided in the end of the paper delivery path, in such a manner that one side and the other side of the paper sheet alternately face up.

A prior art paper sheet folding apparatus comprises, as shown in FIG. 7, (i) a paper guide 51 disposed in a fixed condition, (ii) a feed roller 53 for letting out a continuous paper sheet 52 along the paper guide 51 and (iii) a swing guide 54 that is disposed under the paper guide 51 and swings through a specified angle. The continuous paper sheet 52, which has been let out downwards along the paper guide 51, is swayed back and forth (from side to side in FIG. 7) by the swing guide 54 at folding line intervals so that the sheet 52 is folded on a paper receiving table 55 such that one side and the other side alternately face up in a regular manner.

SUMMARY OF THE INVENTION

Such a conventional paper sheet folding apparatus presents the problem that when the swinging angle of the swing guide 54 is great, the swing guide 54 imposes a great load (that is mainly a friction resistance) on the continuous paper sheet 52, bringing the sheet 52 into an unstable traveling condition. As a result, the continuous paper sheet 52 is likely to slip in the position of the feed roller 53 or a paper jam tends to occur within the swing guide 54.

To solve this problem, there has been made an attempt in Japanese Patent Application No. 5-38732 (1993) in which a movable paper guide made from a flexible, deformable synthetic resin material is provided in the paper transfer station between the paper guide 51 and the swing guide 54. According to the application, since the movable paper guide always follows the movement of the swing guide 54, the load applied to the continuous paper sheet 52 which is traveling from the paper transfer station to the paper discharging end of the paper delivery path can be reduced, so that the unstable traveling condition of the continuous paper sheet 52 can be avoided to a certain extent.

There, however, arises another problem in the above paper folding apparatus equipped with the movable paper guide. If the continuous paper sheet is left in air for a long period before use and loses its rigidity because of increased moisture content, or if the sheet is electrically charged through the development and transfer process in the image forming apparatus so that its electrostatic attractive force increases, the sheet tends to adhere to the inner wall of the movable paper guide. This leads to a paper jam or makes the paper sheet folded and creased. It should be noted that the frequency of paper jamming depends on printing patterns.

With the above problems in view, the invention has been made and one of the objects of the invention is therefore to provide a paper folding apparatus capable of securely preventing the occurrence of a paper jam in the movable paper guide section irrespective of the rigidity or potential of the paper sheet.

This object can be achieved by a paper sheet folding apparatus according to the invention comprising:

(a) a fixed paper guide for guiding a paper sheet;

(b) a swing guide that is provided under the fixed paper guide and swings through a specified angle; and (c) a movable paper guide composed of a pair of members that swing following the swinging movement of the swing guide and have a resistance reducing material on their inner faces respectively.

According to the invention, a paper sheet that has been guided along the fixed paper guide is steadily let into the swing guide by the movable paper guide that follows the movement of the swing guide and then let out from the discharging end of the swing guide. The resistance reducing material provided on the inner face of each member constituting the movable paper guide reduces the resistance between the movable paper guide and the paper sheet, which securely prevents the occurrence of a paper jam in the movable paper guide, even if the paper sheet has been left in air for a long period before use so that it has high moisture content and therefore low rigidity or even if the paper sheet has been charged through the development and transfer process within the image forming apparatus so that its electrostatic attractive force increases. This enables it to smoothly carry out stacking of the paper sheet which bears images thereon.

Preferably, the pair of members constituting the movable paper guide have a base end secured to the lower end of the fixed paper guide and movable ends maintained in a movable condition within the swing guide. Each of the members constituting the movable paper guide may be formed from a synthetic resin sheet.

The resistance reducing material is made from a silicon powdery substance. It is preferable that a sheet tape containing the silicon powdery substance is affixed to each member of the movable paper guide or that the charge removing substance is vapor-deposited on the surface of each member of the movable paper guide. In the case of the sheet tape, although the effect of reducing friction resistance can be satisfactorily achieved by affixing a plurality of strips of the sheet tape to the movable paper guide at specified intervals in parallel with the delivery direction of the paper sheet, it is also possible to apply the sheet tape to the whole inner face of each member of the movable paper guide. A representative example of a resistance reducing material and a charge removing substance is powder.

Other objects of the present invention will become apparent from the detailed description given hereinafter. However, it should be understood that the detailed description and specific example, while indicating a preferred embodiment of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully, understood from the detailed description given hereinbelow and accompanying drawings which are given by way of illustration only, and thus are not limitative of the present invention, and wherein:

FIG. 1 shows the whole structure of an image forming apparatus according to one embodiment of the invention;

FIG. 2 is a perspective view of a paper sheet folding apparatus according to the embodiment of the invention;

FIG. 3 is a longitudinal section of an essential part of the paper sheet folding apparatus according to the embodiment of the invention;

FIG. 4 is a side view of a movable paper guide according to the embodiment of the invention;

FIG. 5 is a sectional view of a sheet tape according to the embodiment of the invention;

FIG. 6 shows the operation of the paper sheet folding apparatus according to the embodiment of the invention; and FIG. 7 shows the operation of a prior art paper sheet folding apparatus.

DESCRIPTION OF THE PREFERRED EMBODIMENT

Referring now to the accompanying drawings, a preferred embodiment of a paper sheet folding apparatus according to the invention will be hereinafter described.

Figure 1:
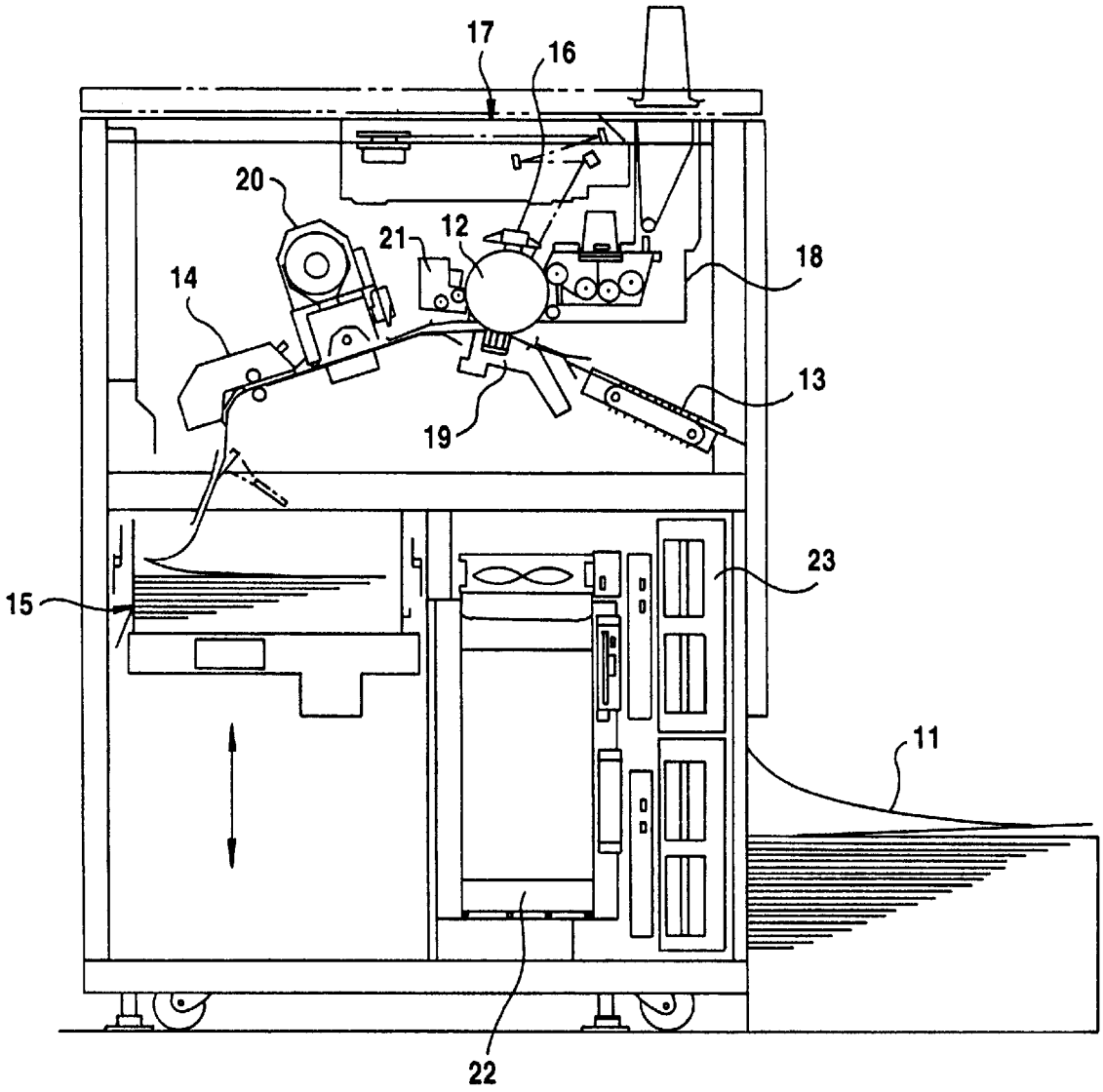
FIGS. 1 to 7 provide a preferred embodiment of a paper sheet folding apparatus according to the invention.

In an image forming apparatus to which the embodiment of the invention is applied, there are provided, as shown in FIG. 1, a tractor unit 13 disposed in the upstream of a photosensitive drum 12 in a paper delivery direction and a scuff roller unit 14 in the downstream of the same. The tractor unit 13 and scuff roller 14 constitute a delivery means for a continuous paper sheet 11 (hereinafter referred to as "paper sheet"). In the downstream of the scuff roller unit 14, there is disposed a stacker unit 15 on which the paper sheet 11 is to be stacked in such a manner that one side and the other side of the paper sheet 11 alternately face up. Disposed around the photosensitive drum 12 are (i) a front charger 16 for uniformly, charging the surface of the photosensitive drum 12; (ii) an optical system 17 for projecting light to areas other than images on the surface of the photosensitive drum 12 which has been charged by the front charger 16 in order to form electrostatic latent images; (iii) a development unit 18 for adhering toner to the electrostatic latent image formed by the optical system 17 to form visible images, the toner being opposite in polarity to the electrostatic latent images; (iv) a transfer guide unit 19 for overlaying the paper sheet 11 on the toner images formed by the development unit 18 and providing an electric charge the polarity of which is opposite to that of the toner to the paper sheet 11 from the back thereof in order to transfer the toner images onto the paper sheet 11, utilizing electrostatic force; (v) a fixing and smoke remover box unit 20 for fusing the transferred toner images by heat or pressure to permanently fix to the paper sheet 11; and (vi) a cleaner unit 21 for removing residual toner remaining on the photosensitive drum 12. In FIG. 1, reference numeral 22 designates a control unit and reference numeral 23 an interface unit.

Figure 2:
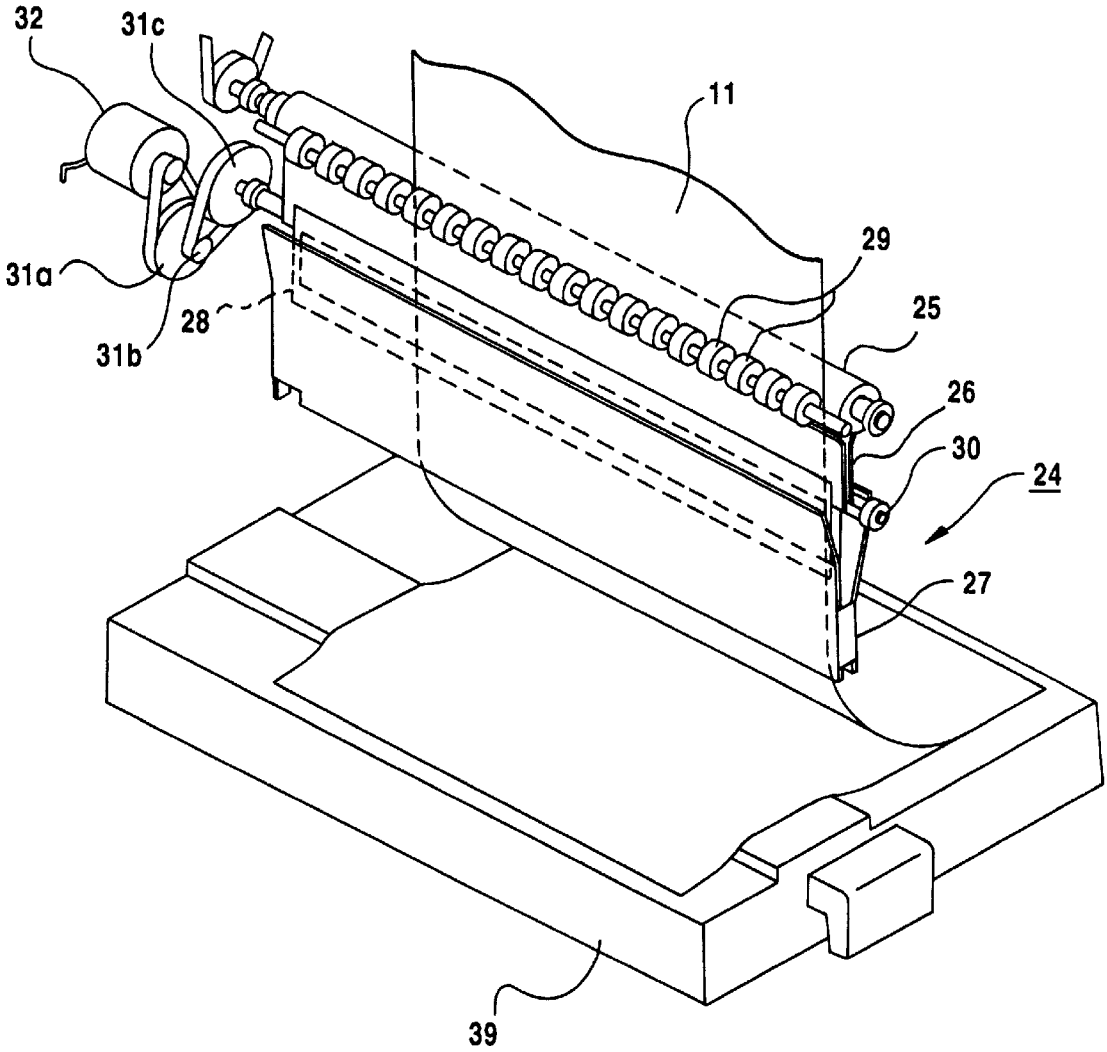

There is provided a paper sheet folding apparatus 24 according to the embodiment of the invention between the scuff roller unit 14 and the stacker unit 15. As shown in FIG. 2, the paper sheet folding apparatus 24 comprises (i) a fixed paper guide 26 to which a feed roller 25 for letting out the image-bearing paper sheet 11 is attached; (ii) a swing guide 27 that is disposed under the fixed paper guide 26 and swings through a specified angle; and (iii) a movable paper guide 28 that is disposed at a paper transfer station between the fixed paper guide 26 and the swing guide 27 and that has a lower end that sways following the movement of the swing guide 27. On the side opposite to the feed roller 25, a plurality of presser rollers 29 are disposed on a shaft, for sending out the paper sheet 11 which is being pressed against the feed roller 25 by a pressing means (not shown).

Figure 3:
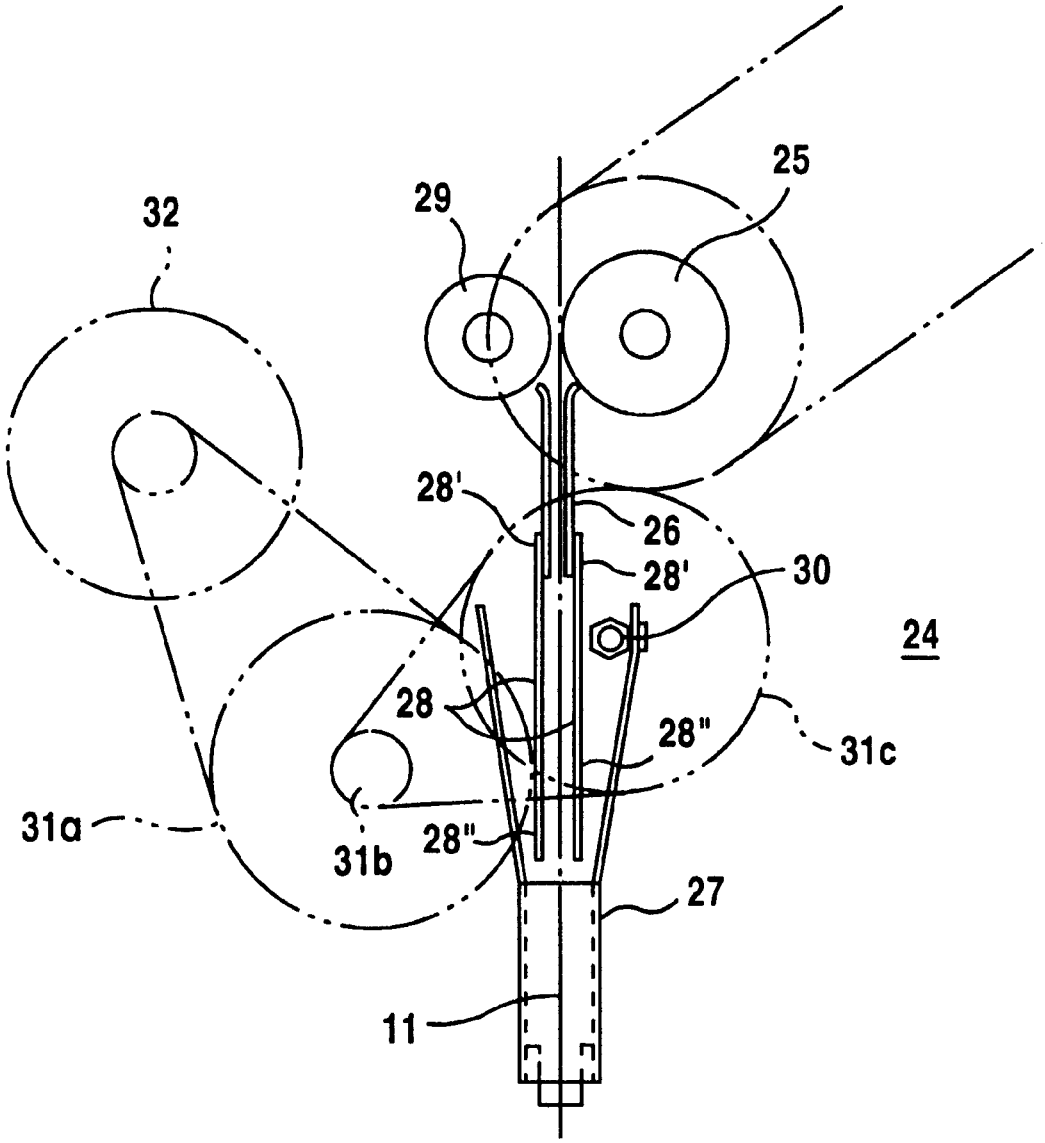

As shown in FIGS. 2 and 3, the upper end of the swing guide 27 is attached to a rotary shaft 30 supported b) a frame of the machine body (not shown) in the terminal of a paper discharge station from which the image-bearing paper sheet 11 is sent out by the delivery means, in such a way that the swing guide 27 swings through a desired angle in a lateral direction in FIG. 3 (i.e., in a direction perpendicular to the sides of the paper sheet 11). The swing guide 27 is composed of two opposed plates (metal plates) separated by a specified distance and the upper half of each plate inclines outwardly. The two plates are connected to each other by side plates at the lateral ends thereof so that the swing guide 27 takes the form of an elongated box with the upper and lower ends open. In addition, the swing guide 27 is suspended such that the bisector of the swinging angle of the swing guide 27 substantially coincides with the direction in which the paper sheet 11 is sent out from the fixed paper guide 26. The driving force of a motor 32 is transmitted to the rotary shaft 30 by means of belts wound around pulleys 31*a*, 31*b* and 31*c*, reversely rotating the rotary shaft 30 about a specified angle, which causes the swing guide 27 to swing through a specified angle.

The movable paper guide 28 is composed of two rectangular flexible sheets. The base ends 28' of the two sheets are respectively secured to the lower ends of the outer faces of the fixed paper guide 26 so as to form the delivery path for the paper sheet 11, while their movable ends 28" are inserted in the swing guide 27, extending across the width of the swing guide 27. As the flexible sheets constituting the movable paper guide 28, sheets made from a synthetic resin such as polyester or polypropylene or extremely thin metal sheets may be employed. Preferably, the base ends 28' of the two sheets of the movable paper guide 28 are backed by suitable stiffeners for reinforcement.

Figure 4:
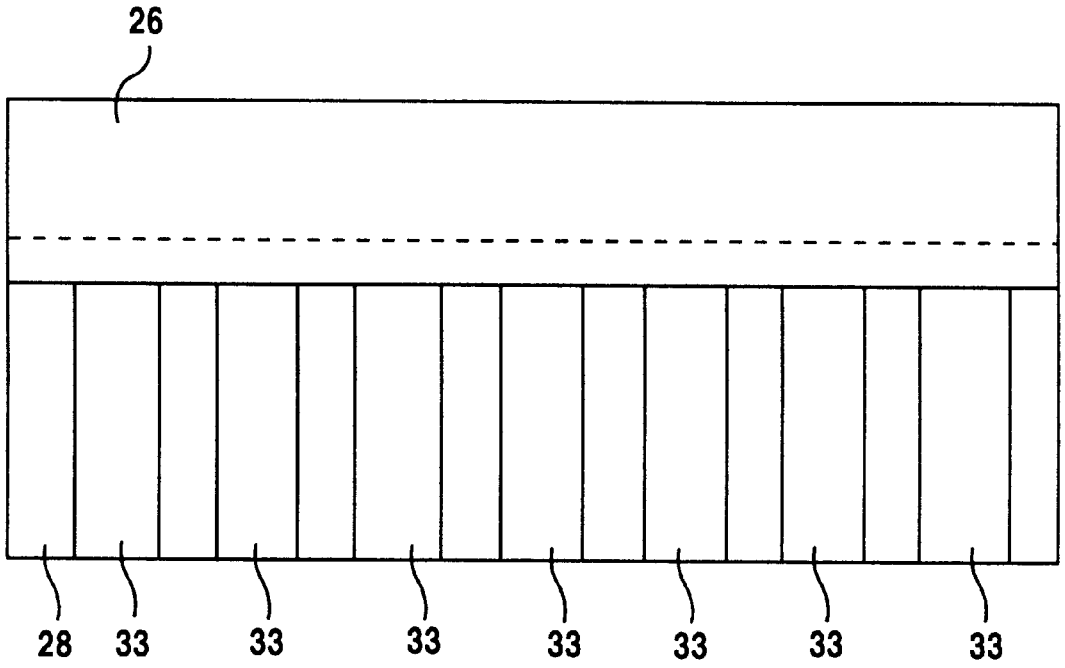
Figure 5:
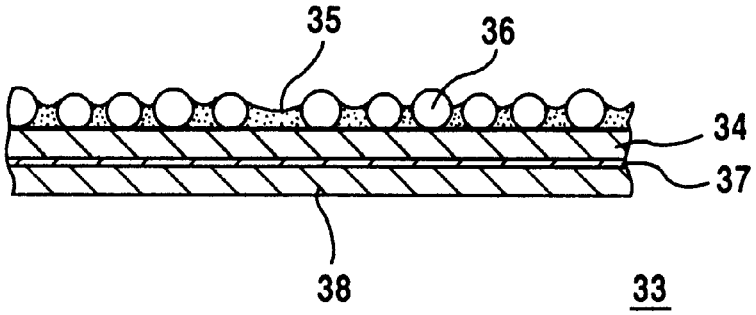

Affixed to the inner faces of the sheets of the movable paper guide 28 are a plurality of strips of sheet tape 33 (seven strips in the example shown in FIG. 4) that contain a resistance reducing material substance. As shown in FIG. 4, the strips of the sheet tape 33 are so affixed as to extend downwards from the lower edge of the fixed paper guide 26 made from a metal in a direction parallel with the delivery direction of the paper sheet 11. As shown in FIG. 5, the sheet tape 33 is comprised of a base film 34 made from polyester to the surface of which silicon powder 36 (glass beads) is adhered with the help of an acrylic binder 35 (the binder may contain aluminum powder). A pressure-sensitive adhesive 37 is applied to the back face of the base film 34 and the surface of the layer of the adhesive 37 is covered with at protective paper sheet (released paper sheet) 38. After stripping off the protective paper sheet 38, the sheet tape 33 is affixed to the inner face of each sheet of the movable paper guide 28 by pressing its surface by a roller. Indium oxide may be used as the charge removing substance. The sheet tape 33 is, for example, 0.3 mm thick, 40 mm long and 10 mm wide.

Figure 6:
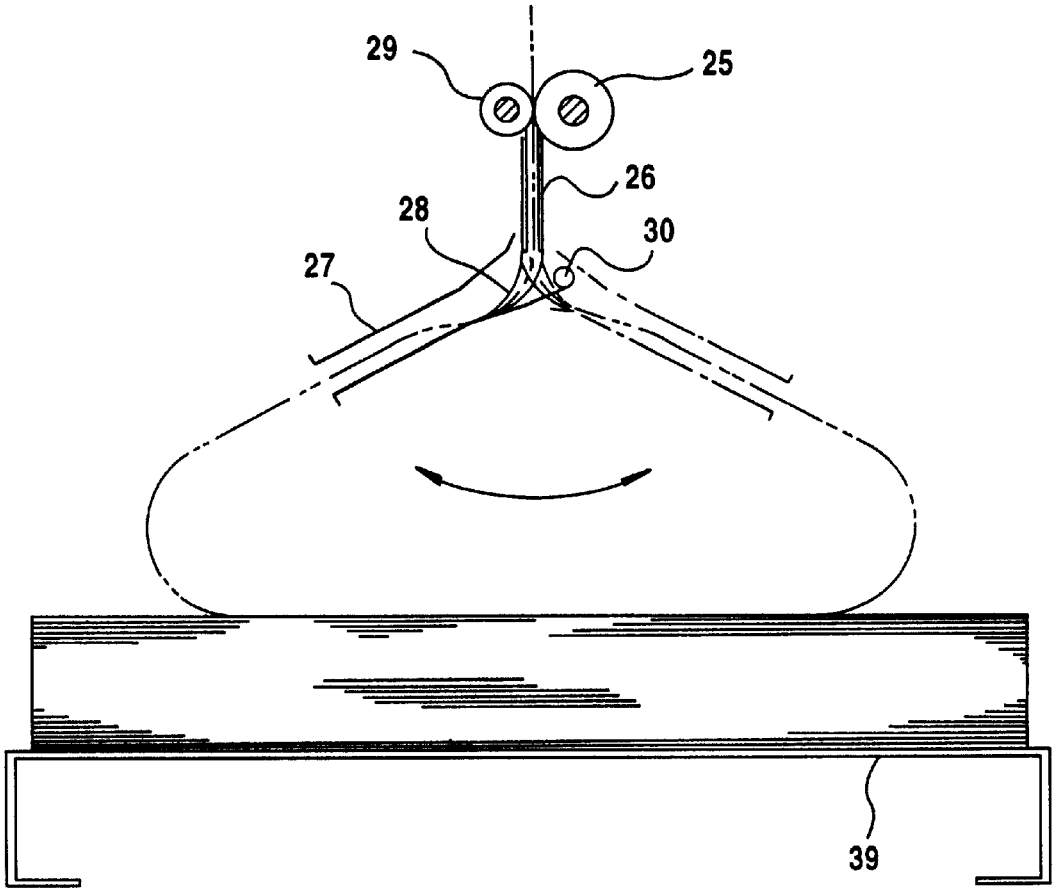
Figure 7:
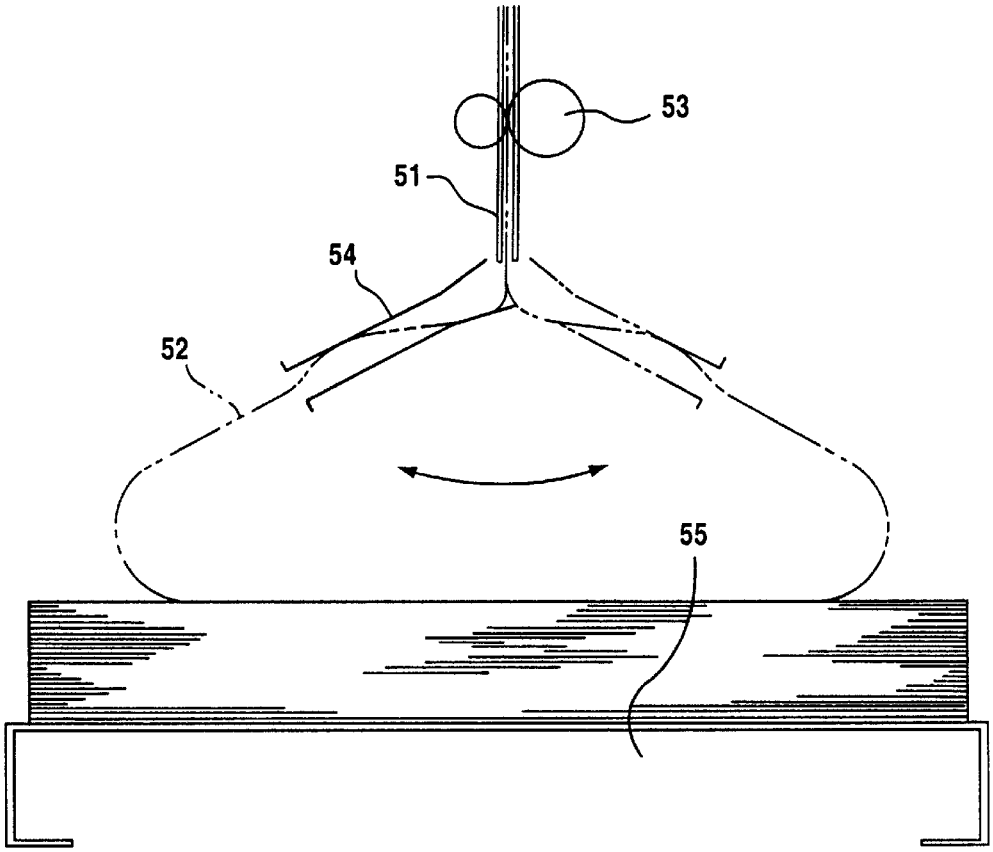
FIG.7 PRIOR ART

In such a paper sheet folding apparatus 24, while guided by the fixed paper guide 26, the image-bearing paper sheet 11 is sent out, as shown in FIG. 6, by the feed roller 25 which rotates at a specified speed with the driving force transmitted from the delivery system. The paper sheet 11 is then lead into the swing guide 27, being held between the sheets of the movable paper guide 28. With such arrangement, even if the motor 32 drives the swing guide 27 so as to swing through a large angle, the paper sheet 11 can be sent out in a stable condition without congestion because the movable paper guide 28 follows the movement of the swing guide 27, bending its movable parts in the form of a circular arc. Since the sheet tape 33 is affixed to the inner faces of the sheets constituting the movable paper guide 28 and reduces the contact area of the movable paper guide 28 and the paper sheet 11, thereby reducing friction resistance, the paper sheet 11 will not adhere to the inner face of the movable paper guide 28 so that a paper jam and folding/creasing of tile paper sheet 11 will be securely prevented in the movable paper guide 28, even if the paper sheet 11 has been left in air for a long period before use, losing its rigidity due to increased moisture content, or even if the paper sheet 11 has been electrically charged through the development and transfer process within the image forming apparatus so that its electrostatic attractive force increases.

In this way, the paper sheet 11 is successively shaken off the swing guide 27 every desired length so that the paper sheet 11 is folded according to the folding lines and stacked on the table 39 of the stacker unit 15 in such a fashion that one side and the other side face up alternately. When the paper sheet 11 is being stacked, the table 39 is repeatedly moved up and down by means of a driving unit (not shown) and, in the meantime, descends gradually in accordance with the height of the stacked paper sheet 11. While a plurality of strips of the sheet tape 33 are affixed to the movable paper guide 28 in parallel with the delivery direction of the paper sheet 11 in the foregoing embodiment, it is also possible to affix the sheet tape 33 to the whole inner face of each sheet constituting the movable paper guide 28. Alternatively, the sheet tape 33 may be applied to only the leading end of the movable paper guide 28 which often comes in contact with the paper sheet 11.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A paper folding apparatus comprising:

(a) a fixed paper guide for guiding a paper sheet;

(b) a swing guide means for swinging through a predetermined angle, said swing guide means being provided, attached to an end of the fixed paper guide, under the fixed paper guide; and (c) a movable paper guide composed of a pair of synthetic resin sheet members that are swingable through said predetermined angle of said swing guide means, said pair of members having inner faces provided with glass beads for reducing a contact area between said paper sheet and said movable paper guide.

2. The paper sheet folding apparatus as set forth in claim 1, wherein said glass beads are provided on strips of sheet tape affixed to each member of said pair of members of said movable paper guide.

3. The paper sheet folding apparatus as set forth in claim 2, wherein said strips of said sheet tape are affixed at specified intervals in parallel with a delivery direction of said paper sheet.

4. The paper sheet folding apparatus as set forth in claim 2, wherein said strips of sheet tape are affixed to an entire inner face of each member of said pair of members of said movable paper guide.

5. The paper sheet folding apparatus as set forth in claim 1, wherein the glass beads comprise silicon powder.

* * * * *